US005117910A

United States Patent [19]

Brandell et al.

[11] Patent Number: 5,117,910

[45] Date of Patent: Jun. 2, 1992

[54] PACKER FOR USE IN, AND METHOD OF, CEMENTING A TUBING STRING IN A WELL WITHOUT DRILLOUT

[75] Inventors: John T. Brandell, Duncan, Okla.; T. Austin Freeman, Wassenaar, Netherlands

[73] Assignee: Halliburton Company, Duncan, Okla.

[21] Appl. No.: 624,012

[22] Filed: Dec. 7, 1990

[51] Int. Cl.[5] ..... E21B 33/13

[52] U.S. Cl. ..... 166/291; 166/154; 166/185; 166/202; 166/332

[58] Field of Search ..... 166/291, 373, 154, 164, 166/169, 185, 202, 323, 328, 332, 242

[56] References Cited

U.S. PATENT DOCUMENTS

| | | | |
|---|---|---|---|
| 2,602,511 | 7/1952 | Johnson | 166/1 |
| 2,672,199 | 3/1954 | McKenna | 166/191 |
| 3,131,767 | 5/1964 | Chancellor et al. | 166/154 |
| 3,524,503 | 8/1970 | Baker | 166/289 |
| 3,527,299 | 9/1970 | Lewis | 166/184 |
| 3,768,556 | 10/1973 | Baker | 166/154 |
| 3,811,500 | 5/1974 | Morrisett et al. | 166/154 |
| 4,260,017 | 4/1981 | Nelson et al. | 166/154 |
| 4,407,369 | 10/1983 | Hutchison et al. | 166/291 |
| 4,469,174 | 9/1984 | Freeman | 166/317 X |
| 4,510,994 | 4/1985 | Pringle | 166/317 X |
| 4,674,569 | 6/1987 | Revils et al. | 166/154 |
| 4,828,037 | 5/1989 | Lindsey et al. | 166/317 X |
| 4,961,465 | 10/1990 | Brandell | 166/184 |

*Primary Examiner*—Terry Lee Melius

*Attorney, Agent, or Firm*—James R. Duzan; E. Harrison Gilbert, III

[57] ABSTRACT

A packer apparatus, particularly a cup type casing packer shoe, includes a pressure-actuated closing sleeve and pressure-actuated pumpout seats. An upper pumpout seat moves with the closing sleeve in response to a first pressure so that the closing sleeve closes ports through which fluid is communicated to an annulus outside the apparatus. Both the upper pumpout seat and a lower pumpout seat and any intervening fluid are pumped out of the apparatus in response to a second, higher pressure so that the apparatus communicates with the well below the annulus without a drillout procedure having to be performed through the apparatus or a tubing string in which the apparatus is connected. A related method is also disclosed.

21 Claims, 4 Drawing Sheets

PACKER FOR USE IN, AND METHOD OF, CEMENTING A TUBING STRING IN A WELL WITHOUT DRILLOUT

BACKGROUND OF THE INVENTION

This invention relates generally to an apparatus and method for conducting a fluid into an annulus within a well and for thereafter providing an open channel communicating with the well. This invention relates more particularly, but not by way of limitation, to a cup type casing packer shoe with closing sleeve and pumpout seats and to a method of cementing a tubing string in a well without having to drill out through the tubing string after the cement has been emplaced.

In wells for the production of oil and gas, casing cemented into a borehole can wear out and leak due to corrosion, wear from various well operations, etc. When this occurs, the casing is typically repaired by cementing a smaller tubing string, such as a smaller diameter casing, inside the old casing.

To cement the smaller string in the damaged string, a packer shoe can be used on the bottom of the smaller string to control the cement during the cementing operation. One type of packer shoe is shown in U.S. Pat. No. 4,961,465 to Brandell.

Prior types of packer shoes have typically required a drillout procedure to clear an entrance into the inner flow channel of the smaller tubing string once the string has been cemented. There are some applications, however, where such drillout is not desirable. For example, if the smaller tubing string which has been cemented is plastic-lined, it would not be desirable to drill out because the lining could be damaged during the drilling procedure.

To use such prior types of packer shoes, a blockage is formed in the shoe by dropping a ball down the tubing string to seal against a ball seat at the lower end of the packer shoe. Cement is then pumped down the tubing string and out one or more ports in the packer shoe above the blockage formed by the ball and ball seat. After the cement has been emplaced, a drill is lowered through the tubing string to drill out the ball and ball seat to open the internal channel of the tubing string to fluid flow into or out of the well below the annular seal established by the packer carried on the shoe at the bottom of the column of cement which has been pumped into the well above the packer.

In view of the foregoing, there is the particular need for a packer shoe which can create the needed blockage to force cement out through ports of the packer shoe, but which can be thereafter unblocked without a drilling procedure. There is also the need for a related method of cementing a tubing string in a well without having to drill out through the tubing string after the cement has been emplaced. More generally, there is the need for an improved apparatus and method for conducting a fluid into an annulus within a well and for thereafter providing an open channel communicating with the well.

SUMMARY OF THE INVENTION

The present invention overcomes the above-noted and other shortcomings of the prior art by providing a novel and improved apparatus and method for conducting a fluid into an annulus within a well and for thereafter providing an open channel communicating with the well. This is particularly adapted to a novel and improved cup type casing packer shoe wherein cement is diverted into an annulus by a blockage in the shoe and thereafter the blockage is pumped out by pressure after one or more ports through the shoe have been closed.

The apparatus broadly comprises: seal means for sealing an end of an annulus in a well; support means for supporting the seal means, which support means has a hollow interior and a port communicating with the hollow interior; and means for enabling the hollow interior to be blocked so that fluid flow into the hollow interior flows out through the port and for enabling the port to be blocked and the hollow interior to be unblocked in response to pressure applied in the hollow interior. In the more particular embodiment, the cup type casing packer shoe comprises: a support adapted to be lowered on a tubing string into a well wherein an annulus is defined adjacent the exterior of the support, which support has a channel defined therethrough and also has a port communicating the channel with the exterior of the support; seal means, connected to the support below the port, for providing a seal at the bottom of the annulus when the support is disposed in a well; a ball seat adapted to move out of the channel; frangible means for releasably connecting the ball seat within the channel of the support below the port so that the port is not blocked by the ball seat; a closing sleeve disposed in the channel of the support so that the closing sleeve is movable between a first position above the port and a second position overlapping the port; a closing seat adapted to move out of the channel; frangible means for releasably connecting the closing seat to the closing sleeve; and frangible means for releasably connecting the releasably connected closing seat and closing sleeve to the support so that the closing seat is releasably retained in the first position.

The present invention also provides a method for conducting a fluid into an annulus within a well and for thereafter providing an open channel communicating with the well. This method comprises: lowering a tubing string into a well, which tubing string includes a packer providing a seal in the well at the bottom of an annulus adjacent the tubing string and having a port defined above where the seal is provided; creating a releasable blockage in the tubing string below the port; closing the port with a pressurized fluid; and releasing the blockage in the tubing string below the port with a pressurized fluid.

Therefore, from the foregoing, it is a general object of the present invention to provide a novel and improved apparatus and method for conducting a fluid into an annulus within a well and for thereafter providing an open channel communicating with the well. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

Figure 1:
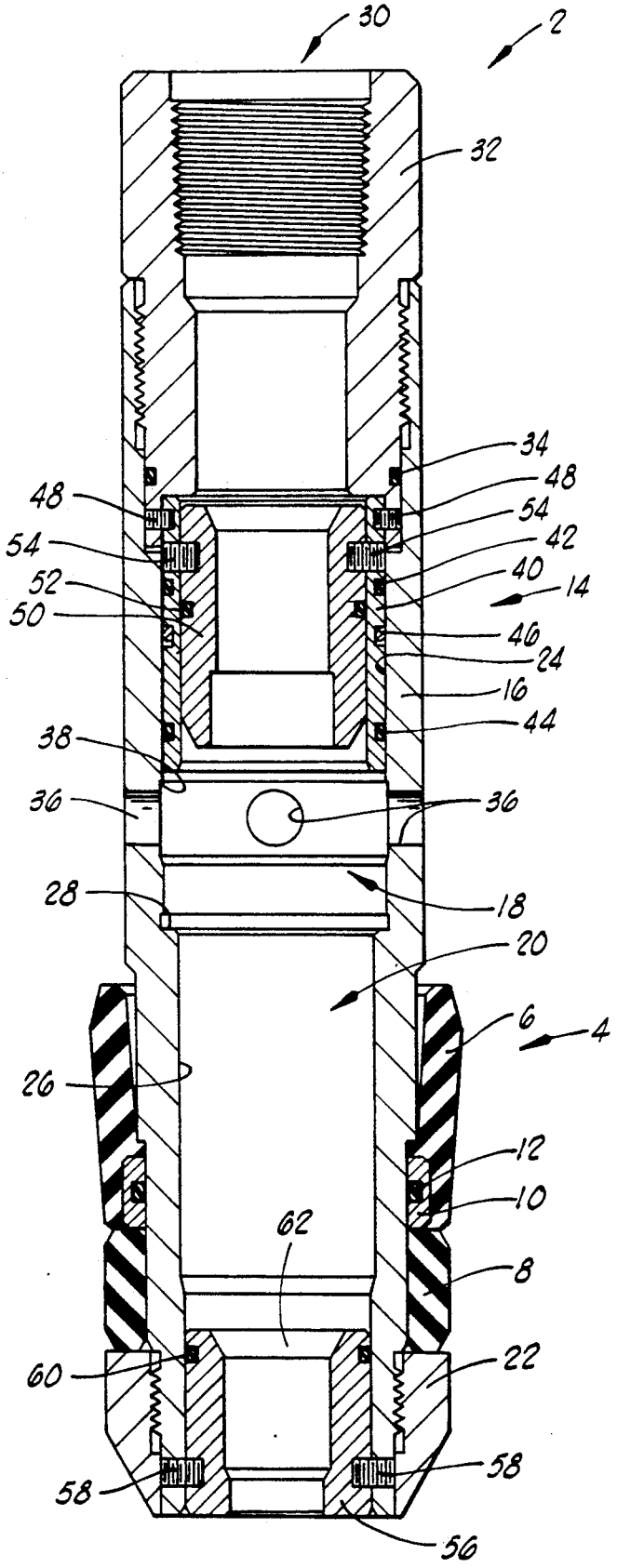
FIG. 1 is a sectional elevational view of a preferred embodiment of the apparatus of the present invention.

A cup type casing packer shoe 2 embodying a preferred embodiment of the present invention is shown in FIG. 1. The apparatus shown in FIG. 1 is used for conducting a fluid, such as cement, into an annulus within a well and for thereafter providing an open channel communicating with the well below the apparatus.

The apparatus 2 includes seal means 4 for sealing an end of the annulus in the well. For the embodiment shown in FIG. 1, this seal is provided at the bottom of the annulus which extends above an upper packer ring 6. The upper packer ring 6 sits on a lower packer ring 8. A reinforcing ring 10 carrying an O-ring 12 also sits on the lower packer ring 8. This construction is known as disclosed in U.S. Pat. No. 4,961,465 to Brandell, incorporated herein by reference.

The seal means 4 is carried and supported on a support means 14. The support means 14 includes a cylindrical mandrel 16 having an upper chamber 18 and a lower chamber 20. The seal means 4 is supported on the lower end of the mandrel 16 outside the lower chamber 20 by a packer retaining member 22 threadedly connected to the thread at the lower end of the mandrel 16 as shown in FIG. 1.

The upper chamber 18 is defined at least in part by a cylindrical interior surface 24 of the mandrel 16. The diameter across the surface 24 is greater than the diameter across cylindrical interior surface 26 defining at least in part the lower chamber 20. An annular shoulder surface 28 at the bottom of the upper chamber 18 intervenes between the different diameter chambers 18, 20.

The upper and lower chambers 18, 20 define at least in part a hollow interior or channel 30 through the support means 14. As illustrated in FIG. 1, the channel 30 is also defined in part by the axial opening through an upper adapter body 32. The axial opening of the body 32 is threaded at its upper portion to engage a tubular member of a tubing string into which the apparatus 2 is connected and forms a part of when the apparatus 2 is used. The threaded end of the adapter body 32 is suitably sized for the size of joint to be made with the tubular member. At its opposite end, the adapter body 32 is threadedly connected to the mandrel 16, and the body 32 carries an O-ring 34 to seal the joint between the mandrel 16 and body 32.

To allow fluid pumped into the channel 30 to exit into the annulus, one or more ports 36 are defined through the mandrel 16 in communication with the upper chamber 18. In the illustrated embodiment, there are four ports 36 defined radially through the mandrel 16 at equally spaced locations around the circumference of the mandrel 16. Adjacent the ports 36 is an annular retaining shoulder 38. The ports 36 communicate the channel 30 with the exterior of the apparatus 2.

The apparatus 2 further comprises means for enabling the hollow interior 30 to be blocked so that fluid flow into the hollow interior 30 flows out through the one or more ports 36 and for enabling the one or more ports 36 to be blocked and the hollow interior 30 to be unblocked in response to pressure applied in the hollow interior 30. This is comprised of two general components: means, responsive to pressure, for blocking the ports 36; and means, responsive to pressure, for evacuating from within the support 14 after the ports 36 are blocked a residue of the fluid conducted into the annulus.

Figure 4:
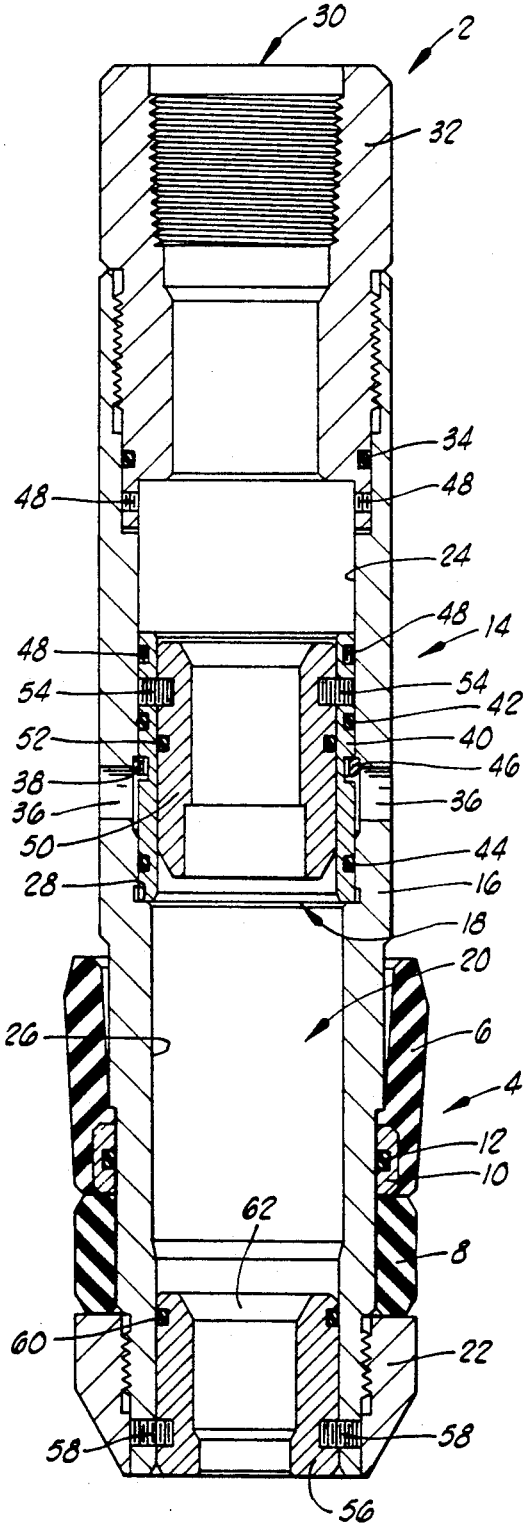
FIG. 4 is the sectional elevational view of the embodiment shown in FIG. 1 but showing a closing sleeve and closing seat subassembly moved to a position blocking outlet ports.
Figure 5:
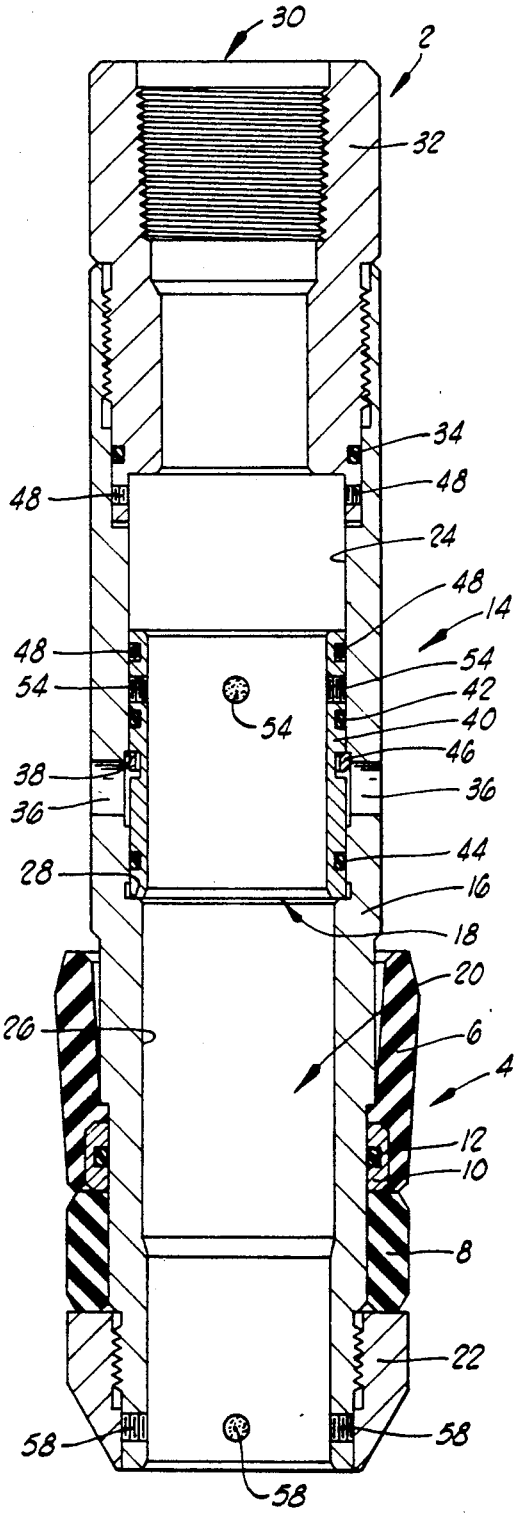
FIG. 5 is a sectional elevational view of the apparatus shown in FIG. 1 shown after the closing seat and a lower ball seat have been pumped out of the apparatus.

The means for blocking the ports 36 includes a closing member 40 releasably connected to the mandrel 16 inside the upper chamber 18. This position of the member 40 is shown in FIG. 1. Upon release, the closing member 40 is movable, in response to a suitable force acting on it, to a lower position wherein the ports 36 are blocked by the closing member 40 (see FIGS. 4 and 5). In the preferred embodiment, the closing member 40 is a cylindrical sleeve having two longitudinally spaced circumferential grooves defined therein for carrying O-rings 42, 44. The sleeve 40 also has a circumferential groove which carries a locking ring 46 providing means for locking the closing sleeve 40 in the lower position as illustrated in FIGS. 4 and 5. This locking occurs with the locking ring 46 engaging the retaining shoulder 38 of the mandrel 16. When the closing sleeve 40 is moved into this lower position, the locking ring 46 expands in a conventional manner known in the art to engage the retaining shoulder 38. In this lower position, the portion of the sleeve 40 in between the spaced seals 42, 44 overlaps the ports 36 s that the ports 36 are thereby sealed closed.

The means for blocking the port of the preferred embodiment also includes two shear pins 48 made of a suitable material, such as brass. The shear pins 48 are frangible, but they connect the sleeve 40 to the support 14 until a force having at least a predetermined magnitude is exerted on them, which predetermined magnitude is determined by the shear strength due to the nature and number of the shear pins 48. For example, the shear pins 48 could be selected to hold the sleeve 40 until a pressure of 400 pounds per square inch is applied in a manner as will be more particularly described hereinbelow. In the FIG. 1 embodiment, the shear pins 48 are received in openings in the lower end of the adapter body 32 and an upper circumferential groove defined in the sleeve 40. These pins 48 hold the sleeve 40 above the ports 36 until the suitable pressure is applied, after which the sleeve 40 slides downwardly until its lower edge abuts the support shoulder surface 28 of the mandrel 16 as shown in FIGS. 4 and 5.

The means for evacuating a residue of fluid from within the channel 30, whereby the channel 30 is opened to fluid flow through the entire length of the apparatus 2 after the ports 36 have been closed by the sleeve 40, includes a seat member 50. The seat member 50 is an upper sealing seat, specifically a latchdown sleeve, which is releasably connected to the closing sleeve 40. The seat member 50 is cylindrical and concentrically disposed within the closing sleeve 40. The seat member 50 has a maximum outer diameter less than the minimum inner diameter of the lower chamber 20 of the mandrel 16 s that the seat member 50 is adapted to be moved out of the channel 30 a will be further described hereinbelow. The seat member 50 has an exterior groove carrying a O-ring 52 to seal between the seat member 50 and the closing sleeve 40.

The seat member 50 is releasably connected to the closing sleeve 40 by four shear pins 54 (only two are shown in FIG. 1). The shear pins 54 withstand a greater force than the shear pins 48 so that the seat member 50 remains connected to and moves with the closing sleeve 40 in response to the predetermined force which is sufficient to shear the pins 48 and move the closing sleeve 40 to its lowermost position, but which is insufficient to shear the pins 54. By way of example, the four shear pins 54 might be selected to withstand a pressure applied in the channel 30 up to 2500 pounds per square inch. The pins 54 are initially received in mating openings through the sleeve 40 into the seat member 50 as shown in FIG. 1.

The means for evacuating also includes a separate seat member 56 releasably connected to the mandrel 16 below the ports 36 and at a location spaced from the releasably connected closing sleeve 40 and seat member 50. As shown in FIG. 1, the seat member 56 is connected at the lower end of the mandrel 16 by shear pins 58 (four are used in the illustrated embodiment, but only two are shown in FIG. 1).

The seat member 56 particularly provides in the preferred embodiment a cylindrical ball seat carrying an 0 ring 60 in a circumferential groove as shown in FIG. 1. A lower circumferential groove or other openings receives the pins 58 held at their outer ends in initially mating openings through the lower end of the mandrel 16 as also shown in FIG. 1. The maximum outer diameter of the ball seat 56 is less than the minimum inner diameter of the lower chamber 20 so that the seat 56 is adapted to move out of the channel 30 when the frangible pins 58 are broken.

In the preferred embodiment, the pins 58 provide a retaining force substantially equal to the retaining force provided by the pins 54 so that both sets of pins 54, 58 are broken in response to a suitable pressure applied through the channel 30 as will be more fully described hereinbelow. The retaining forces provided by the pins 54, 58 are greater than the retaining force provided by the pins 48 so that the seat members 50, 56 are released only after the closing sleeve 40 has been released and lowered to close the ports 36.

Figure 2A:
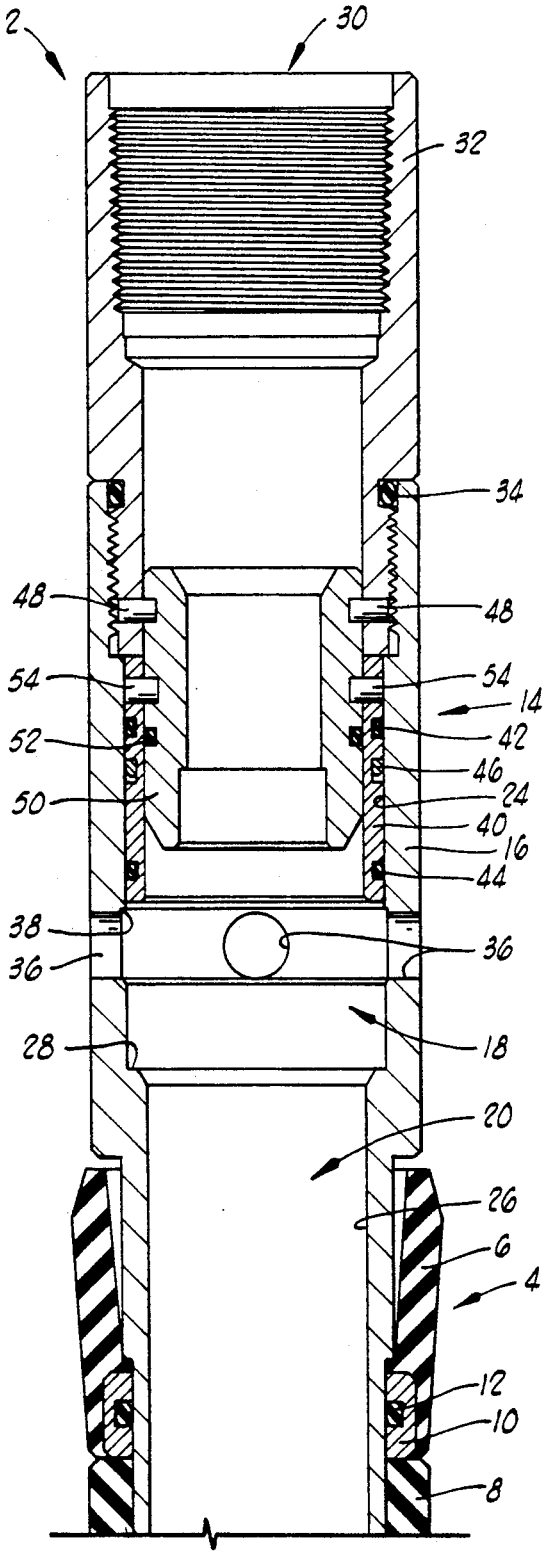
FIGS. 2A and 2B show a sectional elevational view of another preferred embodiment of the apparatus of the present invention.
Figure 2B:
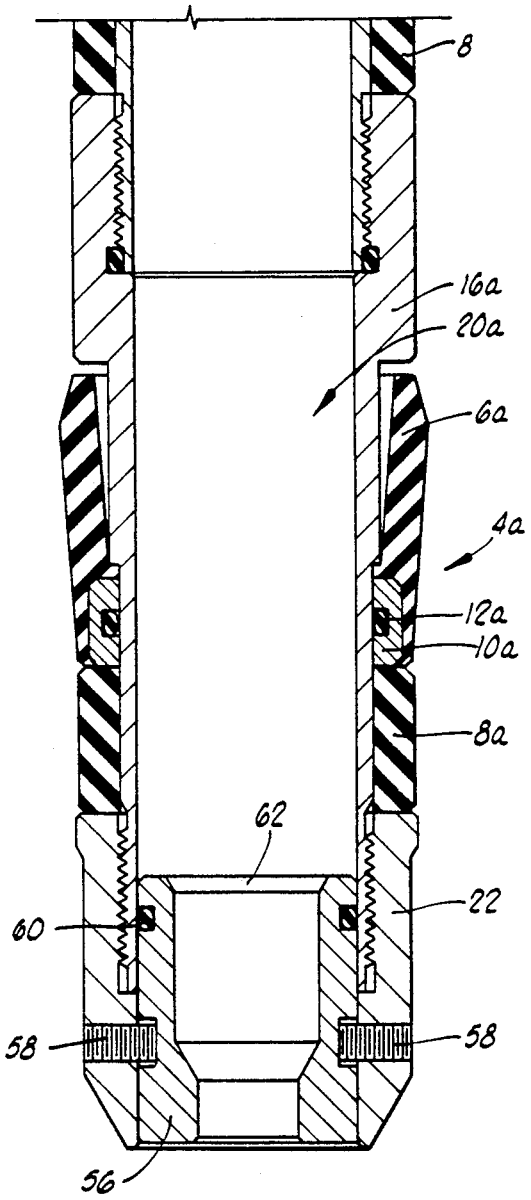
Figure 3:
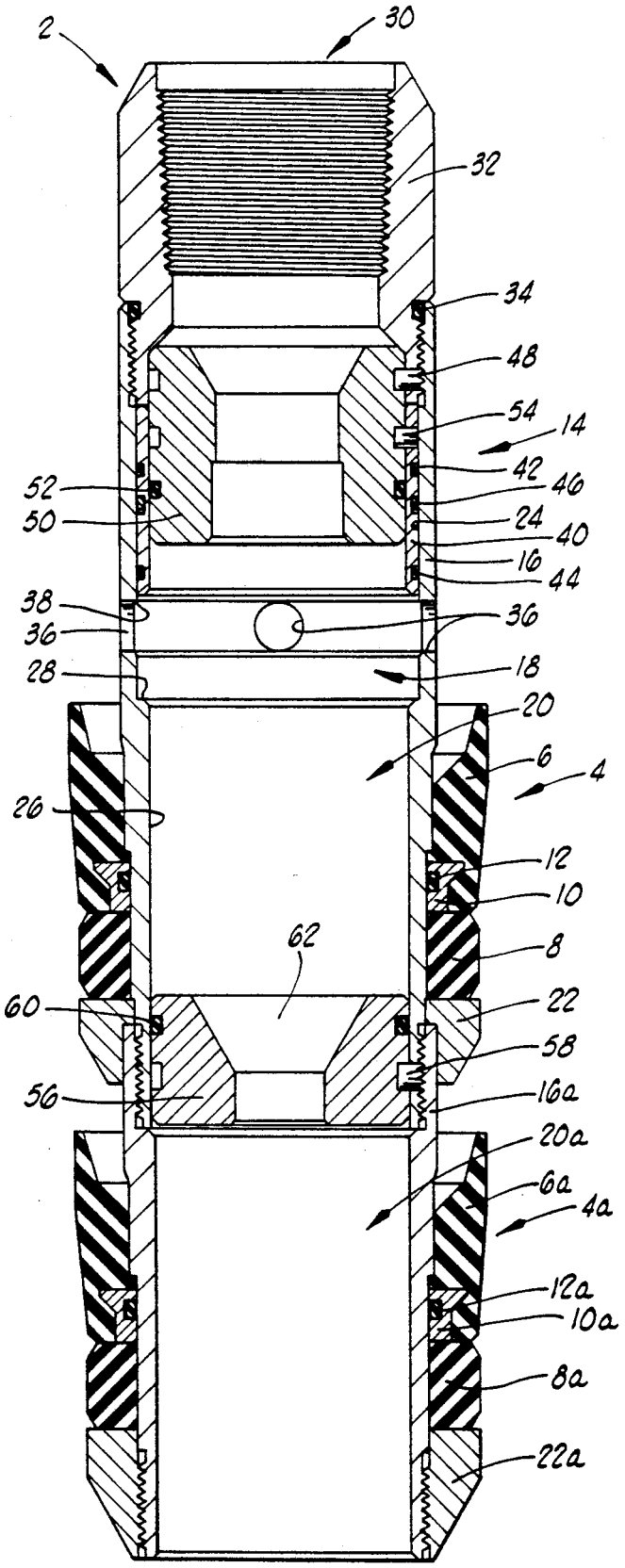
FIG. 3 is a sectional elevational view of a further preferred embodiment of the apparatus of the present invention.

The embodiments of FIGS. 2 and 3 are similar to the embodiment shown in FIG. 1 as indicated by the use of the same reference numerals to identify corresponding parts. The FIG. 2 embodiment, however, shows two sets of packer seals 4, 4*a* with the ball seat 56 located at the lower end of the lower set of packers. Additionally, in FIG. 2 the shear pins 48 are received in the ball seat 50 rather than in the closing sleeve 40; however, the pins 48 still act to releasably retain the closing sleeve 40. With the pins 48 directly engaging the seat member 50 instead of the closing sleeve 40, the force required to shear the lower pressure shear pins 48 is not transferred through the higher pressure shear pins 54.

The FIG. 3 embodiment also has two sets of packer members; however, the ball seat 56 is releasably retained near the lower end of the upper set of packers. Furthermore, the FIG. 3 embodiment is particularly adapted for use inside an open hole rather than inside previously placed casing for which the FIGS. 1 and 2 embodiments are more particularly adapted.

Referring to FIGS. 1, 4 and 5, the operation of the present invention will be described. FIG. 1 shows the initial positioning of the elements which have been previously described. With the apparatus 2 assembled as shown in FIG. 1, it is connected in a conventional manner as part of a tubing string which is to be lowered into a well. This tubing string is lowered into the well in a conventional manner to provide a seal in the well at the bottom of an annulus into which a fluid, typically cement, is to be pumped. The lower end of the annulus is sealed by the seal means 4 in a known manner. This seal is created below the ports 36.

Before the fluid can be pumped through the ports 36 into the thus created annulus, a blockage is created in the tubing string below the ports 36. In the preferred embodiments, this is accomplished by releasing a suitable seal member, such as a sealing ball, into the tubing string. The ball drops through the tubing string, into the channel 30 and ultimately seats in the frusto-conical seat 62 of the ball seat 56. After the sealing member has been received in the lower seat 56, the fluid can be pumped down the tubing string, into the channel 30 and out the ports 36 due to the diversion created by the blockage at the ball seat 56.

After the desired quantity of fluid has been emplaced, the ports 36 are closed using a pressurized fluid. This is done by releasing another seal member into the tubing string. In the preferred embodiments, this includes pumping a conventional latchdown plug down the tubing string and receiving it in the seat member 50.

With the sealed upper blockage formed by the received seal member and the seat member 50, fluid is pumped in the tubing string to create a pressure against this upper blockage. This pressure is increased to the pressure at which the shear pins 48 break. When this occurs, the closing sleeve 40 and the still retained blockage of the seat member 50 and latchdown plug are released. The pressure slides this connected subassembly of sleeve and blockage downward so that the sleeve 40 comes into overlapping position adjacent the ports 36 to seal and close the ports 36. This is the position of the closing sleeve subassembly shown in FIG. 4. A nonlimiting example of a pressure at which the pins 48 might release is 400 pounds per square inch above the circulating pressure.

With the subassembly positioned as shown in FIG. 4, the closing sleeve 40 is locked against both downward and upward movement. Downward movement is prevented by the abutment of the lower end of the closing sleeve 40 against the shoulder surface 28. Upward movement is prevented by the locking ring 46 engaging the shoulder 38.

Once the ports 36 have been closed, the channel 30 through the apparatus 2 needs to be reopened to permit fluid communication between the tubing string and the portion of the well below the packer. Heretofore, this has typically been accomplished by a drillout procedure. The present invention, however, obviates the need for possibly damaging drillout by permitting the blockages to be released by the further application of pressure through the tubing string into the channel 30. In the preferred embodiment, the upper and lower blockages provided at the seat members 50, 56 are released by substantially the same pressure by appropriately matching the sets of shear pins 54, 58. To break these sets of pins, fluid is pumped in the tubing string to a higher pressure than required to break the pins 48. This pressure is applied against the blocked seat member 50 at its FIG. 4 position. When the necessary pressure level is reached, the pins 54 break and the pins 58 break as the force is transmitted through the seat member 50, intervening residue fluid within the lower chamber 20 and on through the blocked ball seat 56. Because the maximum outer diameters of the seat members 50, 56 are less than the minimum inner diameter of the lower chamber 20, this releasing pressure also ejects the released members and intervening fluid out through the lower end of the mandrel 16. A non-limiting example of the pressure used to release the sets of shear pins 54, 58 is 2500 pounds per square inch. The shear pins 54, 58 are made of a suitable material known in the art, such as brass. The shear pins 54, 58 ca be selected both in nature and number so that different shear strengths are provided; thus, the upper and lower blockages can be set to release at different pressures.

The present invention prevents the need for drillout because the internal seats have been shear pinned to the cup mandrel so that sufficient pressure applied through the tubing string shears the pins and pushes the internal blockage components out the bottom of the tool. A closing sleeve is also included to shift down over the cementing ports to hold the cement column in place. Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps ca be made by those skilled in the art, which changes are encompassed within the spirit of this invention as defined by the appended claims.

What is claimed is:

1. A packer apparatus for conducting a fluid into an annulus within a well and for thereafter providing an open channel communicating with the well, said packer apparatus comprising:

seal means for sealing an end of an annulus in a well;

support means for supporting said seal means, said support means having a hollow interior and a port, disposed above said seal means, for communicating said hollow interior with the annulus; and means for enabling said hollow interior to be blocked below said port so that pressurized fluid flow into said hollow interior flows out through said port into the annulus above said seal means and for enabling said port to be blocked and said hollow interior to be unblocked below said port in response to increased pressure applied in said hollow interior to said means for enabling.

2. An apparatus for conducting a fluid into an annulus within a well and for thereafter providing an open channel communicating with the well, said apparatus comprising:

seal means for sealing an end of an annulus in a well;

support means for supporting said seal means, said support means having a hollow interior and a port, communicating with said hollow interior; and means for enabling said hollow interior to be blocked so that fluid flow into said hollow interior flows out through said port and for enabling said port to be blocked and said hollow interior to be unblocked in response to pressure applied in said hollow interior, said means for enabling including:

a closing member releasably connected to said support means in a first position wherein said port is unblocked by said closing member, said closing member movable upon release in response to a first pressure acting on said closing member to a second position wherein said port is blocked by said closing member; and a seat member releasably connected to said support means at a location spaced from said closing member, said seat member releasable in response to a second pressure, greater than said first pressure, acting on said seat member so that said seat member is released only after said closing member is released.

3. The apparatus of claim 2, wherein said means for enabling further includes locking means for locking said closing member in said second position.

4. The apparatus of claim 2, wherein said means for enabling further includes another seat member, said another seat member releasably connected to said closing member and spaced from the first-mentioned said seat member so that said another seat member moves with said closing member in response to said first pressure before the first-mentioned said seat member is released in response to said second pressure.

5. An apparatus for conducting a fluid into an annulus within a well and for thereafter providing an open channel communicating with the well, said apparatus comprising:

seal means for sealing an end of an annulus in a well;

support means for supporting said seal means, said support means having a hollow interior and a port, communicating with said hollow interior; and means for enabling said hollow interior to be blocked so that fluid flow into said hollow interior flows out through said port and for enabling said port to be blocked and said hollow interior to be unblocked in response to pressure applied in said hollow interior, said means for enabling including:

a lower sealing seat;

first shear pin means for connecting said lower sealing seat to said support means;

a sleeve;

an upper sealing seat;

second shear pin means for connecting said upper sealing seat to said sleeve; and third shear pin means for connecting said connected upper sealing seat and said sleeve to said support means.

6. The apparatus of claim 1, wherein said means for enabling includes:

means, responsive to pressure, for blocking said port; and means, responsive to pressure, for evacuating from within said support means after said port is blocked a residue of the fluid conducted into the annulus.

7. The apparatus of claim 1, wherein said means for enabling includes means, releasably connected to said support means above said port, for blocking said port after being released from said releasable connection to said support means.

8. The apparatus of claim 7, wherein said means for enabling further includes:

means, releasably connected to said support means below said port, for receiving a sealing ball; and means, releasably connected to said means for blocking, for receiving a latch-down plug.

9. An apparatus for conducting a fluid into an annulus within a well and for thereafter providing an open channel communicating with the well, said apparatus comprising:

seal means for sealing an end of an annulus in a well, said seal means including a cup type casing packer;

support means for supporting said seal means, said support means having a hollow interior and a port, communicating with said hollow interior and said support means including a mandrel including an upper chamber and a lower chamber defining at least in part said hollow interior, said upper chamber having a greater diameter than said lower chamber wherein said mandrel has an intervening shoulder surface at the bottom of said upper chamber, said mandrel having said port defined therein communicating with said upper chamber and said mandrel having said cup type casing packer retained thereon outside said lower chamber; and means for enabling said hollow interior to be blocked so that fluid flow into said hollow interior flows out through said port and for enabling said port to be blocked and said hollow interior to be unblocked in response to pressure applied in said hollow interior, said means for enabling including:

a closing sleeve disposed within said upper chamber;

a closing seat disposed concentrically within said closing sleeve, said closing seat having an outer diameter less than the diameter of said lower chamber;

first shear pin means for retaining said closing seat to said closing sleeve;

second shear pin means for retaining said retained closing seat and closing sleeve at a first position in said upper chamber above said port so that said port is not blocked by said closing sleeve in said first position, said second shear pin adapted to release said retained closing seat and closing sleeve in response to a first pressure so that said closing sleeve moves to a second position abutting said shoulder surface of said mandrel and overlapping said port;

a ball seat having an outer diameter less than the diameter of said lower chamber; and third shear pin means for retaining said ball seat in said lower chamber below said cup type casing packer, wherein said first shear pin means is adapted to release said closing seat and said third shear pin means is adapted to release said ball seat in response to a second pressure which is greater than said first pressure so that said second pressure ejects said ball seat and said closing seat out of said mandrel after said closing seat moves to said second position to close said port.

10. The apparatus of claim 9, wherein:

said mandrel further includes a retaining shoulder adjacent said port;

said closing sleeve has a circumferential groove defined therein; and said means for enabling further includes a locking ring disposed in said groove for engaging said retaining shoulder when said closing sleeve is in said second position.

11. A cup type casing packer shoe, comprising:

a support adapted to be lowered on a tubing string into a well wherein an annulus is defined adjacent the exterior of said support, said support having a channel defined therethrough and also having a port communicating said channel with the exterior of said support;

seal means, connected to said support below said port, for providing a seal at the bottom of the annulus when said support is disposed in a well;

a ball seat adapted to move out of said channel;

frangible means for releasably connecting said ball seat within said channel of said support below said port so that said port is not blocked by said ball seat;

a closing sleeve disposed in said channel of said support so that said closing sleeve is movable between a first position above said port and a second position overlapping said port;

a closing seat adapted to move out of said channel;

frangible means for releasably connecting said closing seat to said closing sleeve; and frangible means for releasably connecting said releasably connected closing seat and closing sleeve to said support so that said closing seat is releasably retained in said first position.

12. The cup type casing packer shoe of claim 11, said frangible means for releasably connecting said ball seat includes first shear pin means for holding said ball seat in said support until a force having at least a first predetermined magnitude is exerted on said first shear pin means; and said frangible means for releasably connecting said releasably connected closing seat and closing sleeve includes second shear pin means for holding said closing sleeve at said first position until a force exceeding at least a second predetermined magnitude, less than said first predetermined magnitude, is exerted on said second shear pin means.

13. The cup type casing packer shoe of claim 11, wherein said closing seat is disposed concentrically within said closing sleeve.

14. The cup type casing packer shoe of claim 11, further comprising locking means for locking said closing sleeve in said second position.

15. The cup type casing packer shoe of claim 11, wherein:

said support has a shoulder defined therein adjacent said port;

said closing sleeve has a circumferential groove defined therein; and said cup type casing packer shoe further comprises a locking ring disposed in said groove, said locking ring expandible for engaging said shoulder after said closing sleeve has moved to said second position to lock said closing sleeve in said second position.

16. A method for conducting a fluid into an annulus within a well and for thereafter providing an open channel communicating with the well, said method comprising:

lowering a tubing string into a well, which tubing string includes a packer providing a seal in the well at the bottom of a annulus adjacent the tubing string and having a port defined above where the sea is provided;

creating a releasable blockage in the tubing string below the port;

closing the port with a pressurized fluid; and releasing the blockage in the tubing string below the port with a pressurized fluid.

17. The method of claim 16, wherein said closing the port includes sliding a sleeve within the packer from a position above the port to a position overlapping the port.

18. The method of claim 17, wherein said closing the port further includes locking the sleeve in the position overlapping the port.

19. The method of claim 16, wherein said closing the port includes:

creating a blockage in the tubing string above the port;

pressurizing fluid within the tubing string sufficiently to release the blockage in the tubing string above the port; and moving a sleeve within the packer with the released blockage so that the sleeve blocks the port.

20. The method of claim 16, wherein:

said creating a releasable blockage includes moving a ball down the tubing string into sealing engagement with a ball seat releasably retained in the packer by at least one first shear pin;

said closing the port includes:

moving a latch-down plug down the tubing string into engagement with a latch-down seat releasably connected by at least one second shear pin to a closing sleeve releasably retained by at least one third shear pin in the packer above the port; and pumping fluid against the latch-down plug with a pressure sufficient to break the third shear pin and thereby release the sleeve from its position above the port and to move the sleeve to a position blocking the port so that the port is closed; and said releasing the blockage in the tubing string below the port includes pumping fluid against the latch-down plug at a pressure at least sufficient to break the at least one second shear pin and thereby release the latch-down seat from the closing sleeve and to break the at least one first shear pin and thereby release the ball seat from the packer and to move the released seats out of the packer.

21. A method of cementing a tubing string in a well without having to drill out through the tubing string after the cement has been emplaced, said method comprising:

lowering a tubing string into a well;

sealing the lower end of an annulus, defined within the well outside the tubing string, below a port defined through the tubing string;

releasing a first seal member into the tubing string;

receiving the first seal member in a lower seat releasably retained in said tubing string below the port;

pumping cement into the tubing string;

diverting pumped cement through the port into the annulus n response to the received first seal member;

releasing a second seal member into the tubing string;

receiving the second seal member in an upper seat releasably retained in a closing sleeve releasably retained in the tubing string above the port;

pumping fluid in the tubing string to create a first pressure against the received second seal member so that the closing sleeve, to which the upper seat is still retained is released and moved into overlapping position adjacent the port to close the port; and pumping fluid in the tubing string to create a second pressure against the received second seal member so that the upper seat and the lower seat are released and moved out of the tubing string.

* * * * *